US006936207B1

(12) United States Patent
Goby

(10) Patent No.: US 6,936,207 B1
(45) Date of Patent: Aug. 30, 2005

(54) METHOD FOR PRODUCTION OF DRAWN SEALS

(75) Inventor: André Goby, Kappelen (FR)

(73) Assignee: Stoba AG, Horn (CH)

( * ) Notice: Subject to any disclaimer, the term of this patent is extended or adjusted under 35 U.S.C. 154(b) by 0 days.

(21) Appl. No.: 10/168,788

(22) PCT Filed: Dec. 21, 1999

(86) PCT No.: PCT/CH99/00618

§ 371 (c)(1),
(2), (4) Date: Sep. 30, 2002

(87) PCT Pub. No.: WO01/46936

PCT Pub. Date: Jun. 28, 2001

(51) Int. Cl.[7] ..... B29C 45/14
(52) U.S. Cl. ..... 264/259; 264/274
(58) Field of Search ..... 264/167, 177.1, 264/177.17, 177.19, 210, 210.1, 280, 286, 264/284, 288.8, 257, 259, 274, 271.1; 24/16 PB

(56) References Cited

U.S. PATENT DOCUMENTS

| | | | | |
|---|---|---|---|---|
| 3,582,453 | A * | 6/1971 | Sloan et al. | 428/167 |
| 3,744,096 | A * | 7/1973 | Kok | 24/16 PB |
| 3,753,586 | A * | 8/1973 | Patterson | 292/322 |
| 4,009,509 | A * | 3/1977 | McCormick | 24/16 PB |
| 4,214,349 | A * | 7/1980 | Munch | 24/16 PB |
| 4,342,477 | A * | 8/1982 | McClure | 292/307 R |
| 4,574,434 | A * | 3/1986 | Shupe et al. | 24/16 PB |
| 4,680,834 | A * | 7/1987 | Andre et al. | 24/16 PB |
| 4,866,816 | A * | 9/1989 | Caveney | 24/16 PB |
| 5,836,053 | A * | 11/1998 | Davignon et al. | 24/16 PB |
| 6,536,082 | B2 * | 3/2003 | Berrocal et al. | 24/16 PB |
| 6,667,091 | B1 * | 12/2003 | Castro Netto | 428/161 |
| 2003/0066169 | A1 * | 4/2003 | Liu | 24/16 PB |

FOREIGN PATENT DOCUMENTS

| | | |
|---|---|---|
| EP | 0 908 863 | 4/1999 |
| GB | 2 264 463 | 9/1993 |
| GB | 2 265 114 A * | 9/1993 |
| WO | WO 93/19995 * | 10/1993 |

* cited by examiner

*Primary Examiner*—Mark Eashoo
(74) *Attorney, Agent, or Firm*—Flynn, Thiel, Boutell & Tanis, P.C.

(57) ABSTRACT

The tongue material (2) is shaped, in a hot state, immediately after the extrusion thereof, preferably by means of a gear wheel acting upon the tongue material. The tongue material (4) is preferably longitudinally drawn after cooling below the solidification point thereof, with preferably a doubling in length. The final tongue profile (7) is thus achieved which displays a higher stiffness due to the stretching and may be adjusted to length or cut to length. The tongue (7), produced in the above manner, is finally mounted on the base body (8) of the drawn seal (1) by a spray application and forms the final drawn seal (1), together with the sealing body, also preferably mounted to the base body (8) by a spray application. The above is characterized not only by the good stability, but by the adjustable length of the tongue (7) and also a high security on manipulation. The final drawn seal (1) cannot be cut and resealed after installation, without leaving traces on the object to be sealed.

8 Claims, 2 Drawing Sheets

METHOD FOR PRODUCTION OF DRAWN SEALS

Figure 1:
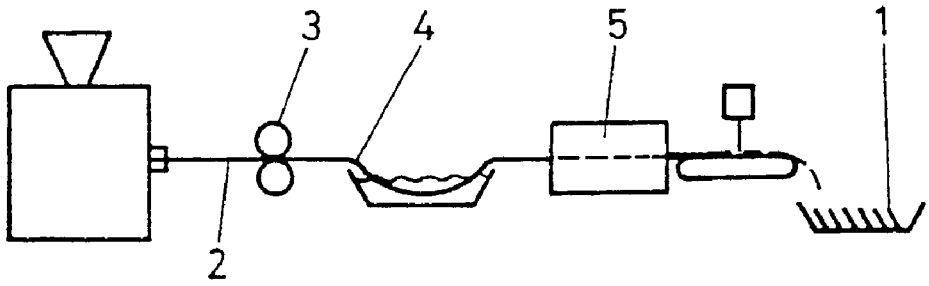

The present invention relates to a method for the manufacture of drawn seals according to the preamble of claim 1.

Drawn seals made of plastic are usually manufactured via an injection molding method. Molds, as a rule metal molds, are manufactured for this purpose, into which molds is subsequently injected under high pressure the plastic in a liquid form, and the drawn seal is manufactured in one piece in one operation.

Such a drawn seal is designed with a base body having a sealing body mounted thereon and a tongue projecting, respectively leading away, from the base body, the tip of which tongue can be placed during use through the sealing body. The tongue has thereby as a rule hold-back means in the form of nubs or teeth which permit the guiding of the tongue through the sealing body in one single direction. However, a pulling back of the tongue is impossible in the opposite direction due to blocking means which are arranged in the sealing body and which act onto the hold-back means of the tongue. Such drawn seals are thus so-called one-way means, namely they can as a rule be only used one time and the seal can be released only through destruction.

The size of the tongue and the type of the sealing body are chosen depending on their use.

The problem now exists that when a long tongue is needed the respective tool, that is the respective shape must be designed relatively large which, on the one hand, results in high costs, and, on the other hand, can result in problems relating to the complete and homogeneous filling of the mold, which in turn cause complicated manufacturing methods, which also result in an increase in the manufacturing costs and thus an increase in the cost of the product.

The purpose of the present invention is to provide a method for the manufacture of drawn seals made of plastic, which method makes it possible to manufacture tongues with practically any desired dimensions without any extra expenses.

This purpose is attained according to the invention by the method defined in claim 1.

Preferred embodiments of the method of the invention can be taken from the further claims 2 to 8.

By manufacturing the tongue of the drawn seal via the extrusion method, practically any desired dimensions, in particular in length, can be advantageously achieved. Furthermore higher strength values are achieved regarding the strength after the profiling and lengthening of the tongue body than is available in common seal tongues manufactured via the injection molding method. Instead of manufacturing many different molding tools for each needed dimension, it is possible to cover with one single extrusion tool and the use of a standardized base body practically all demands on the drawn seals at an expense which is less in comparison to the common method.

A further advantage lies in the possibility of using polyethylene as the plastic for the manufacture of the drawn seal, since through the lengthening operation the orientation of the plastic molecules is changed thereby resulting in an increase of the strength characteristic, and practically the same values as is available in common drawn seals made of polyamide are achieved at much reduced costs.

Figure 2:
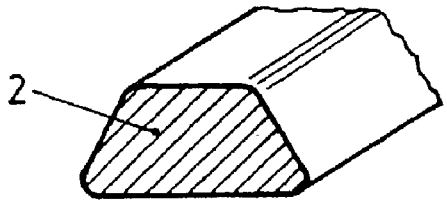
Figure 3:
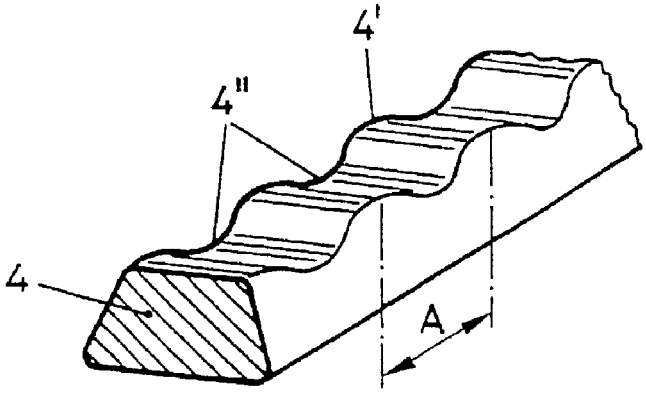
Figure 4:
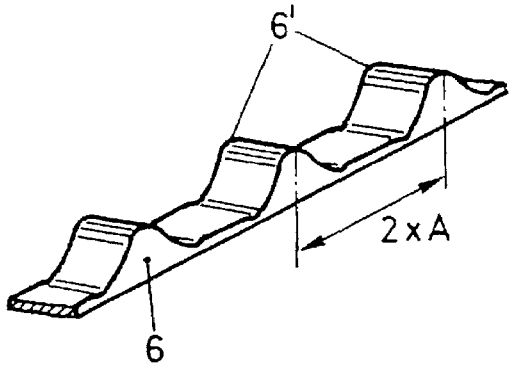
Figure 5:
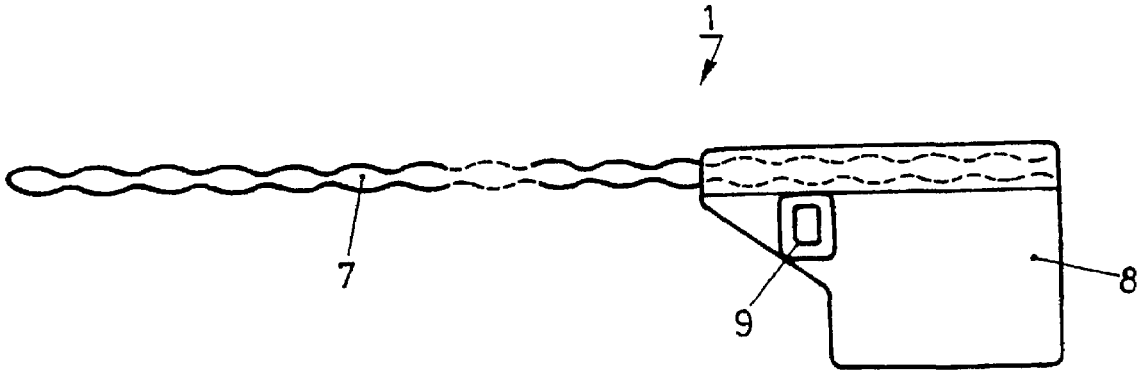

One exemplary embodiment of the invention will be discussed in greater detail hereinafter in connection with the drawing figures, which show in FIG. 1 schematically the process illustration of the manufacturing method of the invention for a drawn seal;

FIG. 2 the cross section of the profile strand of the tongue after the extrusion;

FIG. 3 the cross section of the profile strand of the tongue after profiling by means of a profile wheel;

FIG. 4 the cross section of the profile strand of the tongue after the lengthening operation; and FIG. 5 the view onto a drawn seal manufactured according to the invention.

FIG. 1 schematically illustrates the inventive manufacturing process of a drawn seal 1 made of plastic. The tongue of the drawn seal is manufactured in a first process group by preferably extruding a trapezoidally-shaped profile 2, which is profiled directly after the extrusion. The cross section of the profile strand 2 is illustrated in FIG. 2.

The profiling is preferably done by a profiled wheel 3, which is preferably rollingly pressed onto the short upper side of the extruded profile strand 2. A rack-shaped profile strand 4 is in this manner created, as it is illustrated in FIG. 3. The profile protrusions 4' are preferably spaced apart at a regular distance A.

These two process steps can be carried out advantageously continuously, in contrast to common pressure injection molding methods in molds, which must be carried out individually for each piece. This means that tongues of any desired length can be manufactured with the extrusion method by subsequently cutting the profile strand 4 to the needed length.

This profile strand 4 is thereafter fed to a lengthening process 5, which preferably doubles the length of the profile strand 4. This can advantageously again occur continuously, or can be applied individually as an alternative for the profile pieces already lengthened to the needed dimension. The lengthening process 5 applied to the profiled profile strand 4 leads on the one hand to an orientation of the plastic molecules to effect an increase in the strength characteristic. Thus polyethylene can advantageously be used as the plastic, which is less expensive than polyamide commonly utilized in pressure injection molding methods, however, achieves due to the lengthening ability practically the same strength values as polyamide. This is achieved preferably by lengthening the profile at a temperature of approximately 60° C. A further advantage of this method is that the material upon tensile load breaks practically without expansion when reaching the breaking limit, which makes a nonvisible manipulation of the drawn seal practically impossible.

On the other hand, the tapered sections 4" of the profiled profile strand 4 are in particular lengthened during the lengthening process, and a final profile shape 6 is created which fit together ideally with the resilient hold-back means of the sealing body of the drawn seal. FIG. 4 illustrates the view of a section of such a final profile shape 6, where the profile protrusions 6' preferably are now spaced at twice the distance 2A or more in comparison to the profiled profile strand 4. This enables the drawing in one direction through the sealing body, whereas a pulling back into the opposite direction is made impossible by engagement of the hold-back means against the profile edges of the tongue, as this is known for drawn seals.

The finish profiled tongues 7, which are subsequently cut to the needed length, are now injection molded onto the base body 8 of the drawn seal 1 at the area suitably provided therefor. This creates a strong and tamper-free connection. A further advantage of this method is the possible use of differently colored material for the base body 8 and the tongue 7, which results in additional design freedoms when manufacturing drawn seals 1.

The base member 8 can in a common manner be manufactured, for example, by pressure injection molding methods and can thereby either be equipped in one piece already with the sealing body 9, or same is injection molded in a separate additional process step onto the base body analogously to the tongue 7. This latter method step permits preferably again an increased freedom in design when designing drawn seals 1, in that the sealing body 9 can consist, for example, of many parts and in particular not only of one material but of a combination of various materials. Thus it is possible in particular to use a sealing body 9 with a metal insert, which has an increased drawing resistance to provide assurance against manipulation. FIG. 5 illustrates the view onto a drawn seal 1 manufactured in this manner.

A drawn seal 1 manufactured in this manner has a very high assurance against manipulation since after one manipulation, as for example the cutting open of the tongue 7, this manipulation cannot simply be reversed or cannot be made to be not visible. When preferably polyethylene is used, a cut area cannot again be connected simply by invisible gluing. When heat is used, the material will simply melt and cannot be simply welded as a strong connection.

The introduced manufacturing process can thus be universally utilized for the manufacture of drawn seals 1 with varying tongue lengths and, if necessary, varying sealing bodies 9, and requires merely a minimal number of tools. Of a particular advantage is that it is not necessary to manufacture a separate, special mold for each demanded different length of tongues, and thus the method is also suited for the inexpensive and economical manufacture of small amounts in special sizes or designs. In addition it is also possible to utilize a less expensive plastic, such as polyethylene with non-reduced strength values of the drawn seal 1, than is necessary in the common injection molding method of manufacture with the use of polyamide.

What is claimed is:

1. A method for the manufacture of drawn seals (1) made of plastic with a base body (8) having sealing body (9) and tongue (7) projecting from the base body (8), wherein the tongue (7) is manufactured by extrusion and subsequent profiling and following lengthening in longitudinal direction of the tongue profile, and wherein thereafter the finished tongue profile (7) is connected to the base body (8) by injection molding.

2. The method according to claim 1, wherein the tongue (7) is extruded with a rectangular or trapezoidally-shaped cross section (2).

3. The method according to claim 1, wherein the extruded profile is profiled directly after the extrusion by means of a profiled wheel.

4. The method according to claim 1, wherein the profiled tongue profile is lengthened by the factor two or more in its length.

5. The method according to claim 1, wherein the profiled tongue profile is cooled off prior to the lengthening to under the heat distortion temperature.

6. The method according to claim 1, wherein the sealing body is injection molded onto the base body.

7. The method according to claim 6, wherein a multi-part sealing body (9) is injection molded.

8. The method according to claim 1, wherein polyethylene is used as the material.

* * * * *